United States Patent [19]

Hendrikz

[11] 4,367,120

[45] Jan. 4, 1983

[54] DOCTOR BLADE MOUNTING ASSEMBLY

[75] Inventor: John M. Hendrikz, Bristol, England

[73] Assignee: Vickerys Limited, London, England

[21] Appl. No.: 292,915

[22] Filed: Aug. 14, 1981

[30] Foreign Application Priority Data

Mar. 13, 1980 [GB] United Kingdom ..... 8008560
Mar. 12, 1981 [GB] United Kingdom ..... 8107818

[51] Int. Cl.[3] ..... D21G 3/02; D21G 3/04
[52] U.S. Cl. ..... 162/281; 15/256.51
[58] Field of Search ..... 162/281; 15/256.51

[56] References Cited

U.S. PATENT DOCUMENTS 1,993,352 3/1935 Schwartz ..... 15/256.51
2,732,773 1/1956 Smith ..... 15/256.51
3,778,861 12/1973 Goodnow ..... 162/281 X
4,192,709 3/1980 Dunlap ..... 162/281 X

*Primary Examiner*—Richard V. Fisher
*Attorney, Agent, or Firm*—Watson, Cole, Grindle & Watson

[57] ABSTRACT

A doctor assembly for doctoring a cylinder (12) includes a doctor blade (17) which is retained at its rear end in a blade holder constituted by a multiplicity of adjacent, narrow pivot plates (15) which are individually pivotable about a shaft (14) that is fixed below a rigid support member (10) that is connected to a main support bar (11), and an inflatable bag (28) is disposed between the pivot plates and the rigid support member (10) so as to enable the pivot plates to pivot relative to one another toward and away from the support member (10) and enable the doctor blade attached thereto to conform to the exact shape of the cylinder (12).

10 Claims, 3 Drawing Figures

DOCTOR BLADE MOUNTING ASSEMBLY

BACKGROUND OF THE INVENTION

1. Field of the Invention

This invention relates to an assembly for mounting a doctor blade, such as is used in connection with the roll or cylinder in a paper making machine or other machine for making webs of fibrous material or in laminating, coating or printing machines.

2. The Prior Art

In order for a doctor blade to function effectively, it should be in uniform contact with the coacting roll or cylinder throughout the length of the roll or cylinder, and the blade should be capable of accommodating itself to a crowned or cambered roll or cylinder irrespective of any sagging or distortion to which the blade-mounting assembly may be subject. It is also preferable that provision be made for quickly adjusting a blade in its mounting assembly to its optimum setting with regard to the condition of the material being doctored from the roll or cylinder. A further preferred requirement of a doctor blade and its mounting assembly is that the passage of paper or pulp removed by the blade should not lead to blockages between adjacent rolls or cylinders.

In a typical previous proposal for a doctor blade mounting system a number of "fingers" bear down on the blade, urging it onto the coacting cylinder or roll. Each finger is freely and independently pivotally mounted on a rigid common pivot shaft running parallel to the axis of the coacting cylinder. In order to afford a system of clamping the blade firmly and of averaging out the clamping force exerted by the fingers, it is common practice to provide continuous plates interposed between the doctor blade and the fingers. However, this limits the degree of distortion required of the doctor blade in order that it may accommodate itself adequately to the crowning or distortion of the coacting cylinder.

SUMMARY OF THE INVENTION

The present invention provides a doctor assembly for doctoring a cylinder which comprises a doctor blade; a main support bar extending parallel to the cylinder for applying pressure to the doctor blade so as to urge it into contact with the cylinder; a rigid support member extending forwardly from the main support bar towards the cylinder; a pivot shaft disposed beneath and fixed to the rigid support member and disposed parallel to the cylinder; a blade holder which accommodates the rear end of the doctor blade and extends forwardly towards the cylinder from the pivot shaft, the blade holder being constituted by a multiplicity of closely adjacent rigid pivot plates which are mounted side-by-side on the pivot shaft and capable of independent pivotal movement on the pivot shaft; and a fluid-filled bag which extends parallel to the length of the doctor blade between the support member and the pivot plates at a location between the rear end of the doctor blade and the pivot shaft.

As is conventional, the support bar is biased in use, either by its own weight, by springs or otherwise, to urge the forward end of the doctor blade into contact with the cylinder and the blade is readily able to adapt itself to curvature or discontinuities in the surface of the cylinder since all of the pivot plates can pivot independently to maintain uniform doctoring pressure having regard to the resilience of the inflatable bag which bears against them.

As will be appreciated, the number of pivot plates should be as large as convenient. Their width, measured in the direction of the length of the roll, is preferably $\frac{1}{8}$ inch to $1\frac{1}{4}$ inch. In a typical case the width is $1\frac{1}{4}$ inch, and with a doctor blade having a length of 120 inches the number of pivot plates constituting the blade holder is approximately 96.

One embodiment of the invention will now be described, by way of example, with reference to the accompanying drawings.

DETAILED DESCRIPTION OF THE PREFERRED EMBODIMENT

Figure 1:
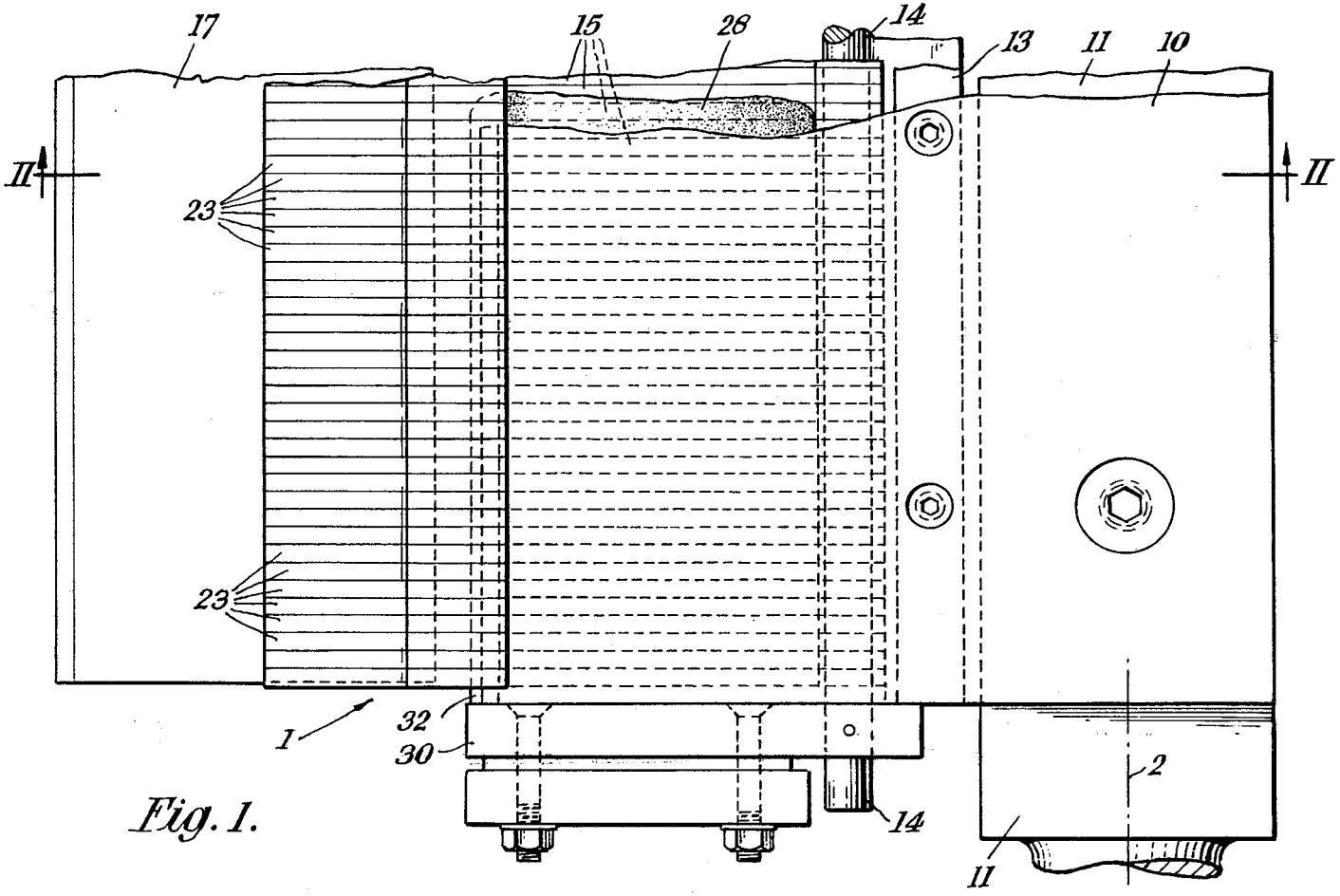
FIG. 1 is a plan view of a portion of a doctor blade assembly according to the present invention.
Figure 2:
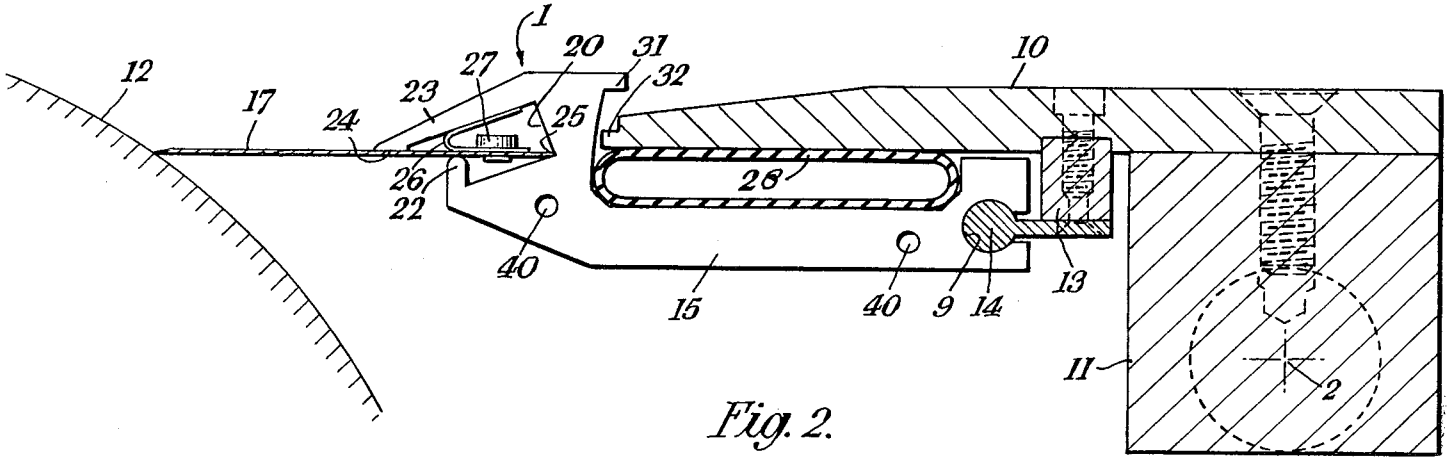
FIG. 2 is a section taken along the line II—II in FIG. 1 and including a portion of a cylinder to be doctored.

The doctor blade assembly 1 shown in the drawings includes a rigid support member 10 attached to a main support bar 11 pivotally mounted on an axis 2 and extending parallel to a cylinder 12 to be doctored. A support bar 13, fixed to the underside of the rigid support member 10, carries a pivot shaft 14 which extends parallel to the axis of the cylinder 12. The shaft 14 is supported along its entire length by the support bar 13 so as to eliminate bending.

A doctor blade 17 for doctoring the cylinder 12 is supported by a blade holder constituted by a multiplicity of juxtaposed steel pivot plates 15, each provided at the rear end with a circular aperture 9 through which the shaft 14 passes. The plane of each pivot plate is perpendicular to the axis of the shaft 14, and the plates are mounted closely together on the shaft for individual independent pivotal rotation about the shaft.

The front end of each pivot plate is cut away and shaped to provide a means for locating and holding the rear end of the doctor blade 17. Each pivot plate locates and holds a portion of the doctor blade in a manner to be described and the entire length of the doctor blade is held and supported by the multiplicity of pivot plates. The cut away and shaped portion of each pivot plate 15 is provided by:

(a) a recess 20 extending diagonally upwards and through the thickness of the plate into the pivot plate from the front end facing the cylinder 12, (b) a bottom portion of the pivot plate which extends upwardly into the entrance to the recess 20 to form a lip 22, and (c) a top portion of the pivot plate which extends downwardly and forwardly of the lip 22 to form a finger 23 terminating in a flat bearing surface 24.

The finger 23 and the lip 22 are so disposed that the corner 25 between the rear wall and the bottom wall of the recess 20 is substantially coplanar with the bearing surface 24 and the top of the lip 22 so that the doctor blade 17 is supported, when it is inserted into the recess, by the bearing surface 24 contacting the upper surface of the blade, by the lip 22 contacting its lower surface, and at its rear edge by the corner 25. The blade is resiliently retained in the recess by a spring 26 compressed between the underside of the finger 23 and the blade 17 and attached to the blade by a rivet 27.

An inflatable, tubular air-bag 28 is located between the underside of the support member 10 and the upper sides of the pivot plates 15 and extends for the length of the plate 10 substantially parallel to the shaft 14. The ends of the air-bag are retained in place by screw-on plates 30 located at the ends of the support plate 10.

Figure 3:
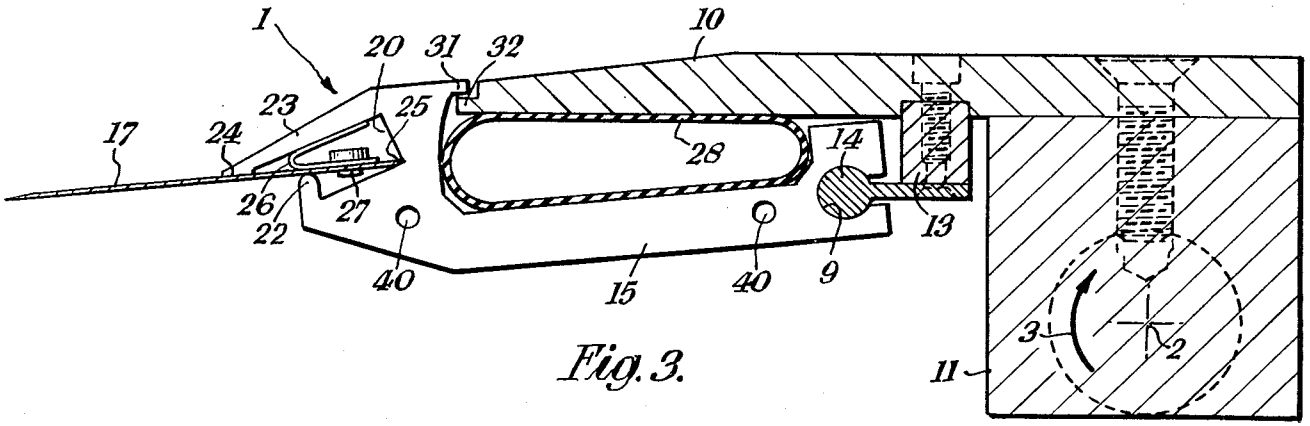
FIG. 3 is the view similar to FIG. 2 but showing an air-bag inflated.

The weight of the support plate 10 pivoting about the axis 2 of the main support bar 11 causes the doctor blade 17 to bear against the cylinder 12 in opposition to the resilience of the air-bag 28 when inflated to a suitable pressure (e.g. 2–4 lbs. per sq. inch). The doctor blade assembly may be lifted from the cylinder 12 by rotating the bar 11 clockwise (as viewed in FIG. 3) in the direction of the arrow 3 about its axis 2 to a release position. Lifting of the doctor blade from the cylinder 12 is then effected by engagement of a projection 32 on the front of the support member 10 with rearwardly extending lugs 31 on the pivot plate 15, as shown in FIG. 3.

It will be seen that the doctor blade is supported by a multiplicity of pivot plates 15 and, owing to the resilience of the air-bag 28, can flex relative to other sections of the blade by virtue of the independent pivoting of the pivot plates 15 about the shaft 14. The doctor blade is thus enabled to conform to the exact shape of the cylinder 12 despite any reasonable amount of crown, camber or other irregular shape the cylinder may have. The narrowness of each pivot plate coupled with the closeness of the pivot plates to each other, effectively provides continuous control over the length of the doctor blade.

Each pivot plate is provided with a circular aperture 40. By inserting a rod through the apertures 40 of a number or all of the pivot plates they may be fixed relative to each other if so desired.

The pivot plates may be easily and cheaply stamped out of sheet steel in large quantities. An individual pivot plate may be easily replaced by sliding it off the shaft 14 and sliding a new pivot plate on.

The sloping fingers 23 enable material to be doctored cleanly off the cylinder without risk of fouling adjacent cylinders or machinery.

If desired a liquid filled bag may be used in place of the air bag 28.

I claim:

1. A doctor assembly for doctoring a cylinder, comprising a doctor blade, a support bar extending parallel to the cylinder for applying pressure to the doctor blade to urge it into contact with the cylinder, a rigid support member extending forwardly from the support bar towards the cylinder, a pivot shaft disposed beneath and fixed to the support member and disposed parallel to the cylinder, a blade holder which accommodates the rear end of the doctor blade, extends forwardly towards the cylinder from the pivot shaft and is constituted by a multiplicity of closely adjacent rigid pivot plates which are mounted side-by-side on the pivot shaft, are devoid of connection with one another so that they are capable of free and independent pivotal movement on the pivot shaft and bear directly at their forward ends against the doctor blade, and a fluid-filled bag which extends parallel to the length of the doctor blade between the support member and the pivot plates at a location between the rear end of the doctor blade and the pivot shaft, the bag bearing directly against the pivot plates.

2. A doctor assembly according to claim 1, in which each pivot plate has at its forward end a recess accommodating the rear end of the doctor blade, a forwardly projecting finger bearing in use against the upper surface of the blade and a lip, disposed rearwardly of the finger and bearing against the lower surface of the blade.

3. A doctor assembly according to claim 2, in which each recess has a corner for abutment by the rear edge of the doctor blade.

4. A doctor assembly according to any one of the preceding claims, wherein the support bar is mounted for pivotal movement about an axis parallel to that of the cylinder and the support member has a projection which coacts with rearwardly extending lugs on the pivot plates to lift the doctor blade from the cylinder on pivotal movement of the support bar to a release position.

5. A doctor assembly according to claim 1, wherein the fluid filled bag is an air bag.

6. A doctor assembly for use in doctoring the surface of a cylinder, said doctor assembly including a main support bar which can be mounted to extend in parallel with the cylinder to be doctored, a rigid support member which is connected to the main support bar so as to extend toward the cylinder to be doctored, a pivot shaft which is connected to the rigid support member so as to be positioned therebelow, a doctor blade which is in the form of a multiplicity of rigid pivot plates that are each pivotally mounted at a first end on the pivot shaft so as to be individually pivotable therearound and in adjacent side-by-side relationship to one another, each rigid pivot plate extending toward the cylinder to be doctored such that its second end extends beyond the end of the rigid support member nearest the cylinder to be doctored, the second end of each rigid pivot plate including a separate mounting means for mounting a doctor blade thereon, a doctor blade mounted in the mounting means of the pivot plates so as to extend toward the cylinder to be doctored, and an inflatable bag positioned between the rigid support member and all of the rigid pivot plates, the inflatable bag containing a fluid such that it applies a uniform pressure against the rigid pivot plates which are otherwise free to pivot with respect to one another so as to allow the doctor blade mounted thereon to conform to the surface of the cylinder being doctored.

7. A doctor blade assembly as defined in claim 6 wherein the mounting means at the second end of each rigid pivot plate comprises a finger which extends downwardly from the upper edge of each rigid pivot plate and a lip which is connected to the lower edge of each rigid pivot plate so as to be located rearwardly of the associated finger, each pivot plate including a recess extending inwardly from its second end and in which the doctor blade is positioned, the finger of each rigid pivot plate contacting the top surface of the doctor blade and the lip bearing against the bottom surface.

8. A doctor blade as defined in claim 7 wherein the recess in the second end of each rigid pivot plate is formed to provide a corner in which the rear edge of the doctor blade can be wedged.

9. A doctor blade as defined in claim 8 wherein the end of the rigid support member nearest the cylinder to be doctored includes a projection portion extending away therefrom, and wherein each rigid pivot plate is shaped to include an upper portion which at least partially surrounds the associated projection portion of the rigid support member, the upper portion of each rigid pivot plate including a rearwardly extending lug which can abut the associated projection portion and result in movement of each rigid pivot plate when the main support bar is rotated.

10. A doctor blade as defined in claim 9 wherein the inflatable bag is positioned between the rigid support member and the rigid pivot plates at a location between the recess formed in each of the rigid pivot plates and the point where they are mounted to the pivot shaft.

* * * * *

UNITED STATES PATENT AND TRADEMARK OFFICE

CERTIFICATE OF CORRECTION

PATENT NO. : 4,367,120

DATED : January 4, 1983

INVENTOR(S) : John Middleton Hendrikz

It is certified that error appears in the above-identified patent and that said Letters Patent are hereby corrected as shown below:

On the title page:

Delete from the heading:

[30] FOREIGN APPLICATION PRIORITY DATA

Mar. 13, 1980 [GB] United Kingdom.....8008560
Mar. 12, 1981 [GB] United Kingdom.....8107818

Signed and Sealed this

*Thirty-first* Day of *May 1983*

[SEAL]

*Attest:*

DONALD J. QUIGG

*Attesting Officer* *Acting Commissioner of Patents and Trademarks*